US008662883B2

(12) United States Patent
Mennie et al.

(10) Patent No.: US 8,662,883 B2
(45) Date of Patent: Mar. 4, 2014

(54) GAS COMBUSTION APPARATUS

(75) Inventors: Darren Mennie, Bristol (GB); Nicholas Benjamin Jones, Nailsea (GB); Colin Michael Harrison, Bath (GB)

(73) Assignee: Edwards Limited, West Sussex (GB)

( * ) Notice: Subject to any disclaimer, the term of this patent is extended or adjusted under 35 U.S.C. 154(b) by 1131 days.

(21) Appl. No.: 11/920,649

(22) PCT Filed: May 3, 2006

(86) PCT No.: PCT/GB2006/001604

§ 371 (c)(1),
(2), (4) Date: Nov. 16, 2007

(87) PCT Pub. No.: WO2006/123092

PCT Pub. Date: Nov. 23, 2006

(65) Prior Publication Data

US 2009/0035709 A1 Feb. 5, 2009

(30) Foreign Application Priority Data

May 16, 2005 (GB) ..... 0509944.5

(51) Int. Cl.
*F23G 7/06* (2006.01)

(52) U.S. Cl.
USPC ..... 431/5; 431/147; 60/272; 60/273; 60/274; 110/345

(58) Field of Classification Search
USPC ..... 431/5, 147; 60/272, 273, 274, 276; 110/345
See application file for complete search history.

(56) References Cited

U.S. PATENT DOCUMENTS 3,946,198 A * 3/1976 Foote ..... 219/497
4,555,389 A 11/1985 Soneta et al.

(Continued)

FOREIGN PATENT DOCUMENTS

CN 88101392 A 10/1988
EP 0 311 317 A2 4/1989

(Continued)

OTHER PUBLICATIONS

Prosecution history of corresponding Chinese Application No. 200680017049.1 including: First Office Action dated Aug. 28, 2009; Response dated Mar. 9, 2010; Second Office Action dated Jul. 30, 2010; Third Office Action dated Nov. 18, 2010.

(Continued)

*Primary Examiner* — Avinash Savani
(74) *Attorney, Agent, or Firm* — Westman, Champlin & Koehler, P.A.

(57) ABSTRACT

Apparatus is described for combusting exhaust gases output from a plurality of process chambers. The apparatus comprises a plurality of exhaust gas combustion nozzles (22) connected to a combustion chamber (24). Each nozzle receives a respective exhaust gas (26), and comprises means for receiving a fuel (40) and an oxidant (30) for use in forming a combustion flame within the chamber. A controller receives data indicative of the chemistry of the exhaust gas supplied to each nozzle, and adjusts the relative amounts of fuel and oxidant supplied to each nozzle in response to the received data. This can enable the nature of each combustion flame to be selectively modified according to the nature of the exhaust gases to be destroyed by that flame, thereby enhancing the destruction rate efficiency of the exhaust gas and optimising fuel consumption.

24 Claims, 7 Drawing Sheets

(56) References Cited

U.S. PATENT DOCUMENTS

| | | | | |
|---|---|---|---|---|
| 5,310,334 | A | 5/1994 | Spiros | |
| 5,603,905 | A * | 2/1997 | Bartz et al. | 422/173 |
| 5,957,678 | A * | 9/1999 | Endoh et al. | 431/5 |
| 6,051,197 | A * | 4/2000 | Park | 423/210 |
| 6,234,787 | B1 * | 5/2001 | Endoh et al. | 431/353 |
| 6,408,611 | B1 * | 6/2002 | Keller et al. | 60/773 |
| 6,736,635 | B1 * | 5/2004 | Takemura et al. | 431/353 |
| 7,165,405 | B2 * | 1/2007 | Stuttaford et al. | 60/737 |
| 2001/0012500 | A1 | 8/2001 | Krodel et al. | |
| 2002/0106599 | A1 * | 8/2002 | Weisenstein et al. | 431/147 |
| 2002/0111526 | A1 | 8/2002 | Seeley | |
| 2004/0006990 | A1 * | 1/2004 | Stuttaford et al. | 60/776 |

FOREIGN PATENT DOCUMENTS

| | | | |
|---|---|---|---|
| EP | 0 819 887 | A2 | 1/1998 |
| EP | 1 205 707 | A2 | 5/2002 |

OTHER PUBLICATIONS

Prosecution history of corresponding European Application No. 06726981.1 including: Office Action dated Oct. 25, 2012; Response dated Mar. 4, 2013.

Prosecution history of corresponding Japanese Application No. 2008-511770 including: Notification of Reason for Rejection dated Oct. 11, 2011; Response dated Dec. 21, 2011.

Prosecution history of corresponding Korean Application No. 2007-7026605 including: Notice of Preliminary Rejection dated Oct. 19, 2012; Response dated Mar. 14, 2013.

Prosecution history of corresponding Taiwanese Application No. 095117062 including: Office Action dated Apr. 20, 2012; Search Report dated Mar. 5, 2012; Response dated Oct. 16, 2012.

United Kingdom Search Report of Application No. GB 0509944.5; mailed Sep. 26, 2005; Claims searched: 1, at least; Date of Search: Sep. 23, 2005.

PCT Notification of Transmittal of the International Search Report and the Written Opinion of the International Searching Authority, or the Declaration of International Application No. PCT/GB2006/001604; Date of mailing: Aug. 14, 2006.

PCT International Search Report of International Application No. PCT/GB2006/001604; Date of mailing of the International Search Report: Aug. 14, 2006.

PCT Written Opinion of the International Searching Authority of International Application No. PCT/GB2006/001604; Date of mailing: Aug. 14, 2006.

* cited by examiner

GAS COMBUSTION APPARATUS

FIELD OF THE INVENTION

The present invention relates to apparatus for, and a method of, combusting a plurality of exhaust gases.

BACKGROUND OF THE INVENTION

A primary step in the fabrication of semiconductor devices is the formation of a thin film on a semiconductor substrate by chemical reaction of vapour precursors. One known technique for depositing a thin film on a substrate is chemical vapour deposition (CVD). In this technique, process gases are supplied to a process chamber housing the substrate and react to form a thin film over the surface of the substrate. For example, silane is commonly used as a source of silicon, and ammonia is used as a source of nitrogen.

CVD deposition is not restricted to the surface of the substrate, and this can result, for example, in the clogging of gas nozzles and the clouding of chamber windows. In addition, particulates may be formed, which can fall on the substrate and cause a defect in the deposited thin film, or interfere with the mechanical operation of the deposition system. As a result of this, the inside surface of the process chamber is regularly cleaned to remove the unwanted deposition material from the chamber. One method of cleaning the chamber is to supply a cleaning gas such as molecular fluorine ($F_2$) to react with the unwanted deposition material.

Following the deposition or cleaning process conducted within the process chamber, there is typically a residual amount of the gas supplied to the process chamber contained in the gas exhaust from the process chamber. Process gases such as silane, ammonia and cleaning gases such as fluorine are highly dangerous if exhausted to the atmosphere, and so in view of this, before the exhaust gas is vented to the atmosphere, abatement apparatus is often provided to treat the exhaust gas to convert the more hazardous components of the exhaust gas into species that can be readily removed from the exhaust gas, for example by conventional scrubbing, and/or can be safely exhausted to the atmosphere.

One known type of abatement apparatus is described in EP-A-0 819 887. This abatement apparatus comprises a combustion chamber having an exhaust gas combustion nozzle for receiving the exhaust gas to be treated. An annular combustion nozzle is provided outside the exhaust gas nozzle, and a gas mixture of a fuel and air is supplied to the annular combustion nozzle for forming a reducing flame inside the combustion chamber for burning the exhaust gas received from the process chamber to destroy the harmful components of the exhaust gas.

In such an apparatus, the amount of fuel supplied to the combustion chamber is pre-set so that it is sufficient to destroy both the process and the cleaning gases contained within the exhaust gas. Due to the requirement to ensure a high destruction and removal efficiency (DRE) for fluorine-containing cleaning gases such as $F_2$, $NF_3$ and $SF_6$, the total amount of fuel is typically determined by the calorific requirement to abate the maximum flow rate of cleaning gases that will enter the combustion chamber. CVD processes alternate between deposition and clean steps with a frequency that is determined by the tool type. Typically the process applications where the device described in EP-A-0 819 887 is used have a deposition step followed by a clean step. As a result, the abatement apparatus operates for around 50% of its time with a higher usage of fuel than is actually required to destroy the process gases associated with the deposition onto the substrate that is being processed.

Another problem that has been encountered with the use of a reducing flame is that a high DRE is not achieved when a high flow rate (for example, around 60 slpm) of exhaust gas containing ammonia is received, for example, from a flat panel display device process chamber.

It is an aim of at least the preferred embodiment of the present invention to seek to solve these and other problems.

SUMMARY OF THE INVENTION

In a first aspect, the present invention provides a method of combusting exhaust gases using a plurality of exhaust gas combustion nozzles for conveying exhaust gas into a combustion chamber, the method comprising the steps of conveying a respective exhaust gas to each nozzle, and, for each nozzle, selectively supplying a fuel and an oxidant for use in forming a combustion flame within the chamber, and adjusting the supply of fuel and oxidant with variation of the chemistry of the exhaust gas conveyed to the nozzle.

In a second aspect, the present invention provides apparatus for combusting exhaust gases, the apparatus comprising a combustion chamber, a plurality of exhaust gas combustion nozzles each for conveying a respective exhaust gas into the chamber, each nozzle having associated therewith respective means for receiving a fuel and an oxidant for use in forming a combustion flame within the chamber, and control means for receiving, for each exhaust gas, data indicative of a variation of the chemistry of the exhaust gas, and for adjusting the supply of fuel and oxidant for combusting that exhaust gas in response thereto.

In a third aspect the present invention provides combustion apparatus comprising a combustion chamber; a plurality of combustion nozzles each for receiving a respective exhaust gas for combustion within the combustion chamber, and for conveying the exhaust gas into the combustion chamber; a plenum chamber having an inlet for receiving a combustion gas comprising a fuel and an oxidant for forming combustion flames within the combustion chamber and a plurality of outlets each extending about a respective nozzle for supplying the combustion gas to the combustion chamber, wherein each combustion nozzle has associated therewith respective means for receiving fuel and oxidant for selectively adjusting the relative amounts of fuel and oxidant supplied to the combustion chamber through the respective outlet from the plenum chamber, the apparatus comprising means for selectively varying the relative amounts of fuel and oxidant supplied to each of said means according to the chemistry of the exhaust gas contained within the nozzle associated therewith.

Features described above in relation to method aspects of the invention are equally applicable to apparatus aspects of the invention, and vice versa.

BRIEF DESCRIPTION OF THE DRAWINGS

Preferred features of the present invention will now be described with reference to the accompanying drawing, in which.

DETAILED DESCRIPTION OF THE INVENTION

Figure 1:
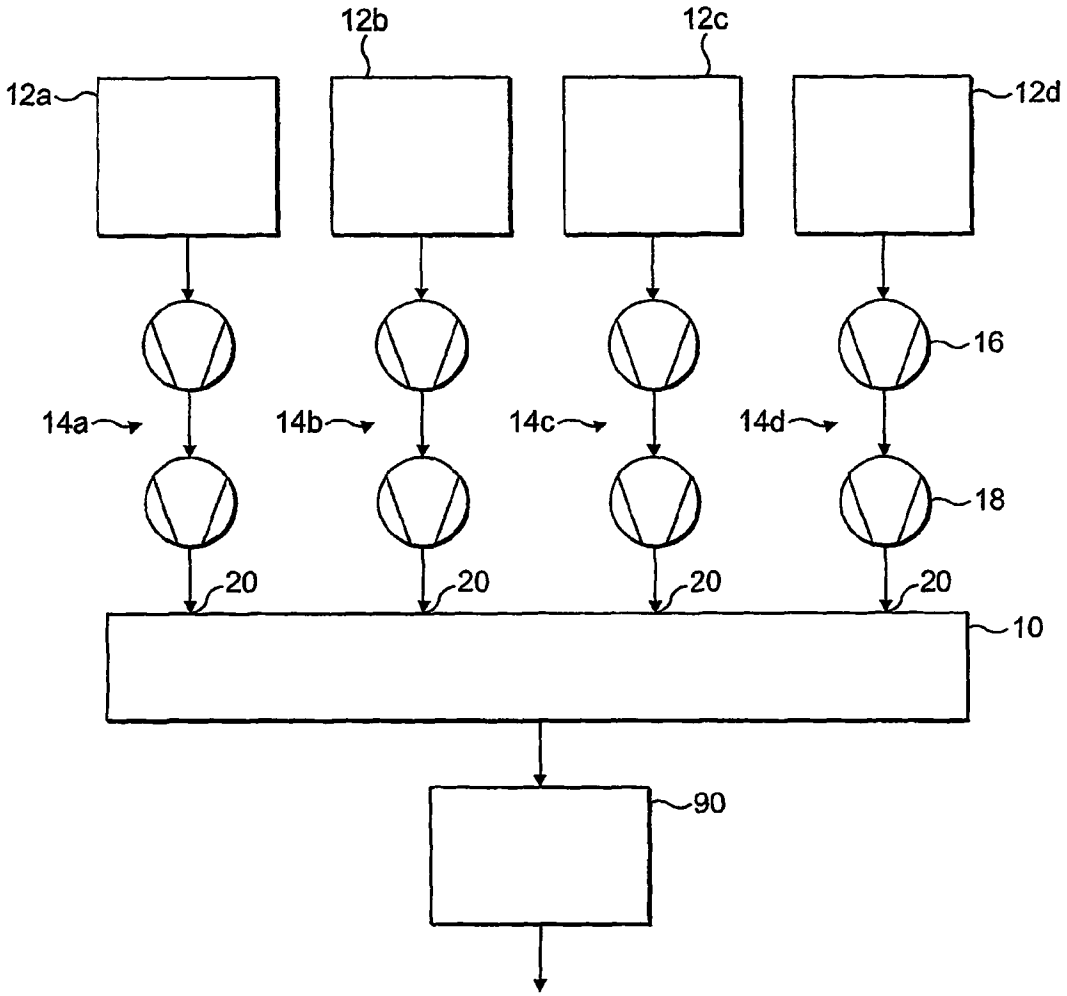
FIG. 1 illustrates a plurality of process chambers connected to a combustion apparatus.

With reference first to FIG. 1, apparatus 10 is provided for treating gases exhausting from a plurality of process chambers 12*a* to 12*d* for processing, for example, semiconductor devices, flat panel display devices or solar panel devices. FIG. 1 illustrates apparatus 10 for treating the gases exhaust from four process chambers 12*a* to 12*d*, although the apparatus is suitable for treating any number of exhaust gases, for example six or more. Each chamber receives various process gases (not shown) for use in performing the processing within the chamber. Examples of process gases include silane and ammonia. An exhaust gas is drawn from the outlet of each process chamber by a respective pumping system. During the processing within the chamber, only a portion of the process gases will be consumed, and so the exhaust gas will contain a mixture of the process gases supplied to the chamber, and by-products from the processing within the chamber.

In this embodiment, deposition processing is performed within each layer to deposit one or more layers of material over the surfaces of substrates located within the process chambers. The nature of the process gases supplied to each process chamber may be the same, or they may be different. In order to remove unwanted deposition material from the process chambers, cleaning gases such as $F_2$, $NF_3$ and $SF_6$ are periodically supplied to the process chambers. The duration of the process gas/cleaning gas supply cycles may the same or different for each of the process chambers. Again, as only a portion of the cleaning gases will be consumed, the gases exhaust from the process chambers during the cleaning cycle will contain admixture of the cleaning gases supplied to the chamber, and; by-products from the chamber cleaning. Certain processes may use a remote plasma system to decompose the cleaning gases into fluorine prior to their admittance into the process chamber.

The exhaust gases are drawn from the outlets of the process chambers by respective pumping systems 14*a* to 14*d*. As illustrated in FIG. 1, each pumping system may comprise a secondary pump 16, typically in the form of a turbomolecular pump, for drawing the exhaust gas from the process chamber. The turbomolecular pump 16 can generate a vacuum of at least $10^{-3}$ mbar in the process chamber. The gas is typically exhausted from the turbomolecular pump 16 at a pressure of around 1 mbar. In view of this, the pumping system also comprises a primary, or backing pump 18 for receiving the gas exhaust from the turbomolecular pump 16 and raising the pressure of the gas to a pressure around atmospheric pressure. Again, depending on the nature of the processing conducted within each process chambers, and the vacuum levels required in the process chambers during processing, the pumping systems 14*a* to 14*d* may be the same, or may vary between the process chambers.

Figure 2:
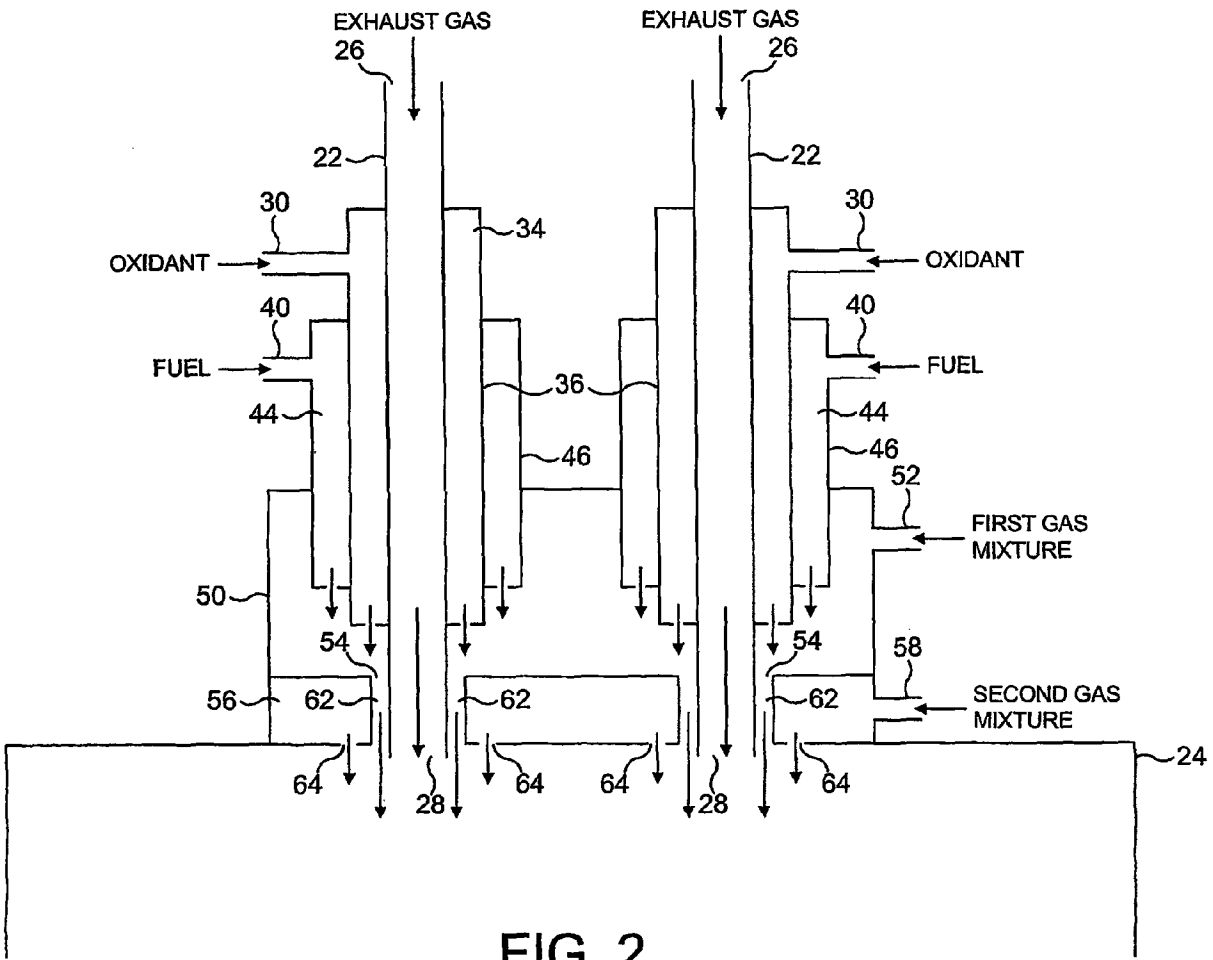
FIG. 2 illustrates a cross-sectional view of a plurality of exhaust gas combustion nozzles connected to a combustion chamber of the combustion apparatus.
Figure 3:
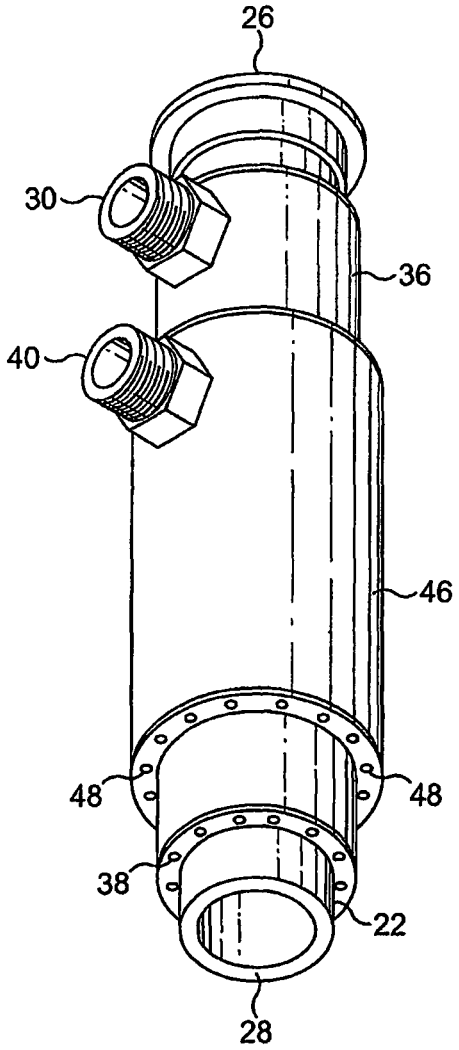
FIG. 3 illustrates a perspective view of a combustion nozzle.

The gases exhaust from the pumping systems 14*a* to 14*d* are each conveyed to a respective inlet 20 of the abatement apparatus 10. As illustrated in FIGS. 2 and 3, each inlet 20 comprises an exhaust gas combustion nozzle 22 connected to a combustion chamber 24 of the abatement apparatus 10. Each combustion nozzle 22 has a flanged inlet 26 for receiving the exhaust gas, and an outlet 28 from which the exhaust gas enters the combustion chamber 24.

Figure 6:
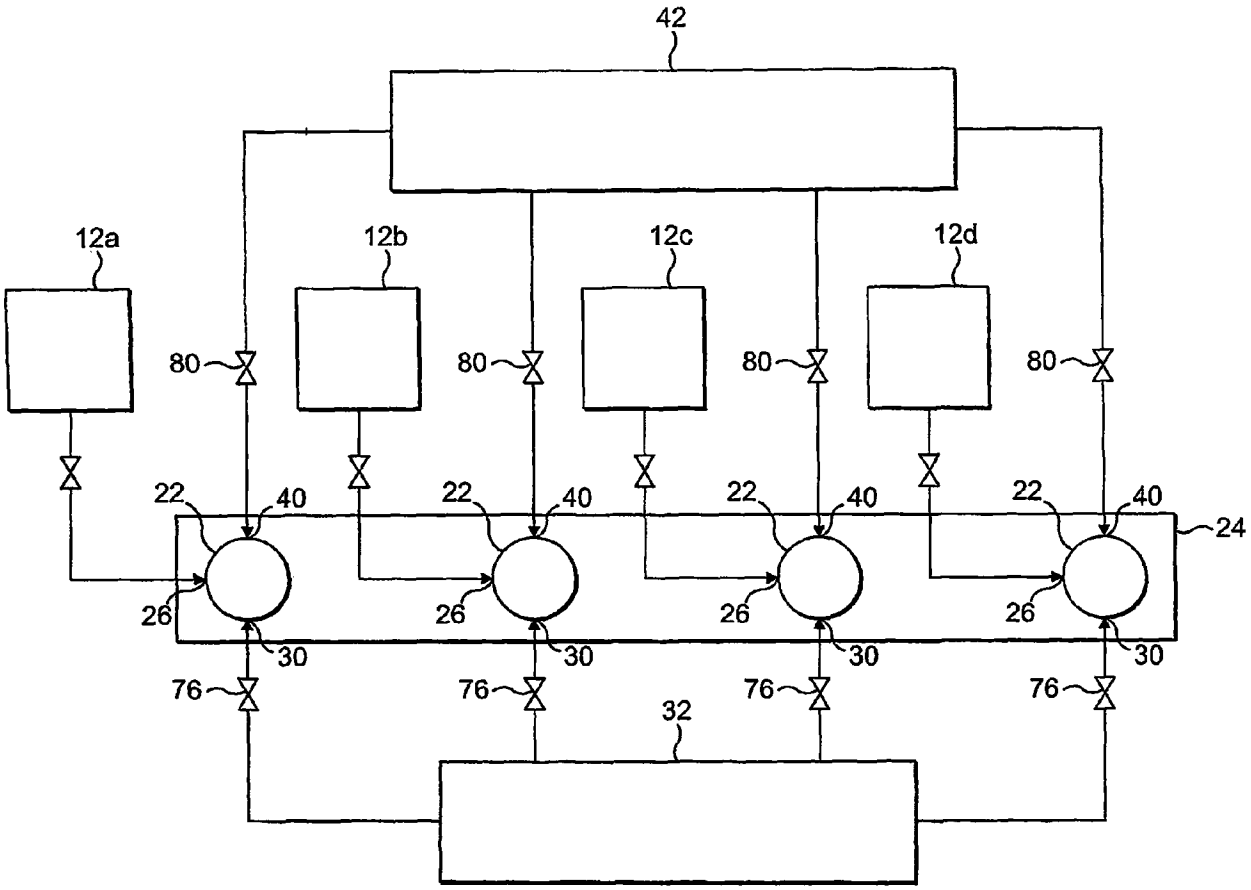
FIG. 6 illustrates an arrangement for supplying a fuel and an oxidant to each combustion nozzle connected to the combustion chamber.

Each combustion nozzle 22 includes an oxidant inlet 30 for receiving an oxidant, such as oxygen, from a source 32 thereof (illustrated in FIG. 6). An annular gap 34 defined between the outer surface of the nozzle 22 and the inner surface of a first sleeve 36 extending about the nozzle 22 allows the oxidant to be conveyed from the inlet 30 to a plurality of oxidant outlets 38 surrounding the nozzle 22.

Each combustion nozzle 22 further includes a fuel inlet 40 for receiving a fuel preferably methane, from a source 42 thereof (also illustrated in FIG. 6). An annular gap 44 defined between the outer surface of the first sleeve 36 and the inner surface of a second sleeve 46 extending about the first sleeve 36 allows the fuel to be conveyed from the inlet 40 to a plurality of fuel outlets 48 surrounding the nozzle 22.

Figure 4:
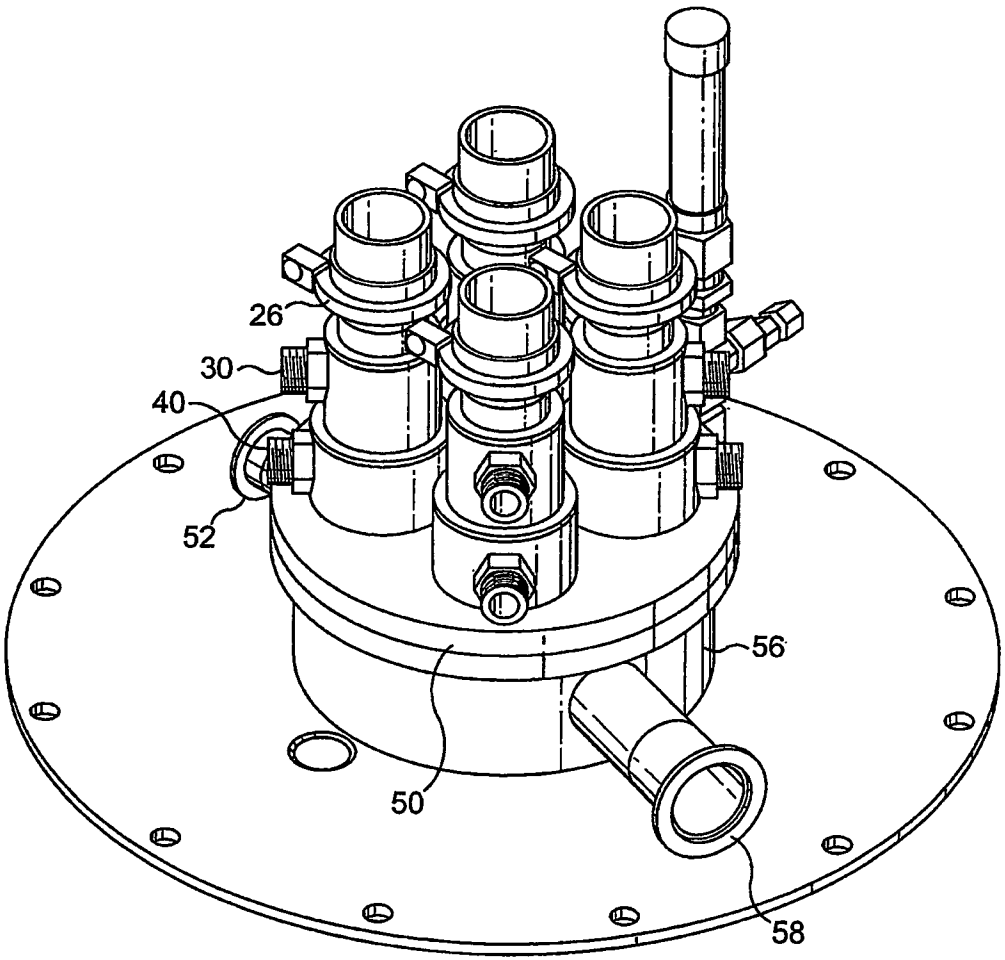
FIG. 4 illustrates a perspective view of a plurality of combustion nozzles located within a first plenum for receiving a first gas mixture for forming combustion flames within the combustion chamber.

As illustrated in FIGS. 2 and 4, each combustion nozzle 22 is mounted in a first annular plenum chamber 50 having an inlet 52 for receiving a first gas mixture of fuel and oxidant, for example, a mixture of methane and oxygen, for forming combustion flames within the combustion chamber 24. As illustrated in FIG. 2, the combustion nozzles 22 are mounted in the first plenum chamber 50 such that the oxidant and fuel outlets 38, 48 from the combustion nozzles 22 are located within the first plenum chamber 50, so that the oxidant and fuel exhaust from these outlets 38, 48 locally mixes with the first gas mixture within the first plenum chamber 50. The resulting local mixture of fuel and oxidant formed from the first gas mixture and the fuel and oxidant supplied to the combustion nozzle 22 enters the combustion chamber 24 through respective outlets 54 from the first plenum chamber 50, each outlet 54 being substantially co-axial with and surrounding the combustion nozzle 22.

Figure 5:
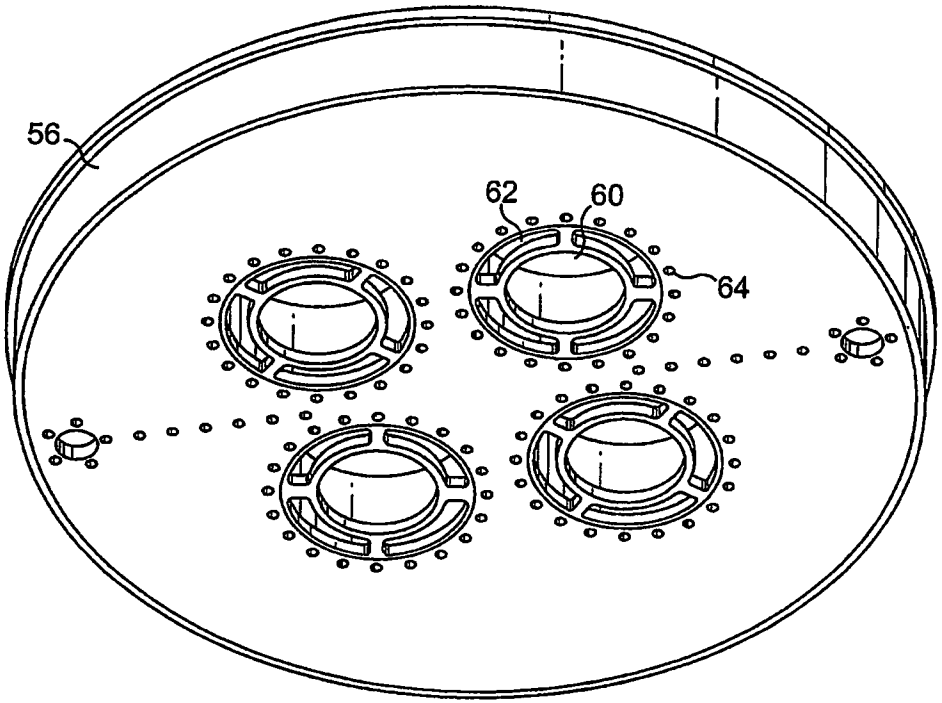
FIG. 5 illustrates a rear perspective view of a second plenum for receiving a second gas mixture for forming pilot flames within the combustion chamber.

As also illustrated in FIG. 2, the first plenum chamber 50 is located above a second annular plenum chamber 56 having an inlet 58 for receiving a second gas mixture of fuel and oxidant, for example, another mixture of methane and oxygen, for forming pilot flames within the combustion chamber 24. As illustrated in FIG. 5, the second plenum chamber 56 comprises a plurality of first apertures 60 through which the exhaust gas enters the combustion chamber 24 from the combustion nozzles 22, a plurality of second apertures 62 each surrounding a respective first aperture 60 through which the localised mixtures of fuel and oxidant enter the combustion chamber 24 from the first plenum chamber 50, and a plurality of third apertures 64 surrounding the second apertures 62 and through which the second gas mixture enters the combustion chamber 24 to form pilot flames for igniting the localised mixtures of fuel and oxidant to form combustion flames within the combustion chamber 24.

Figure 7:
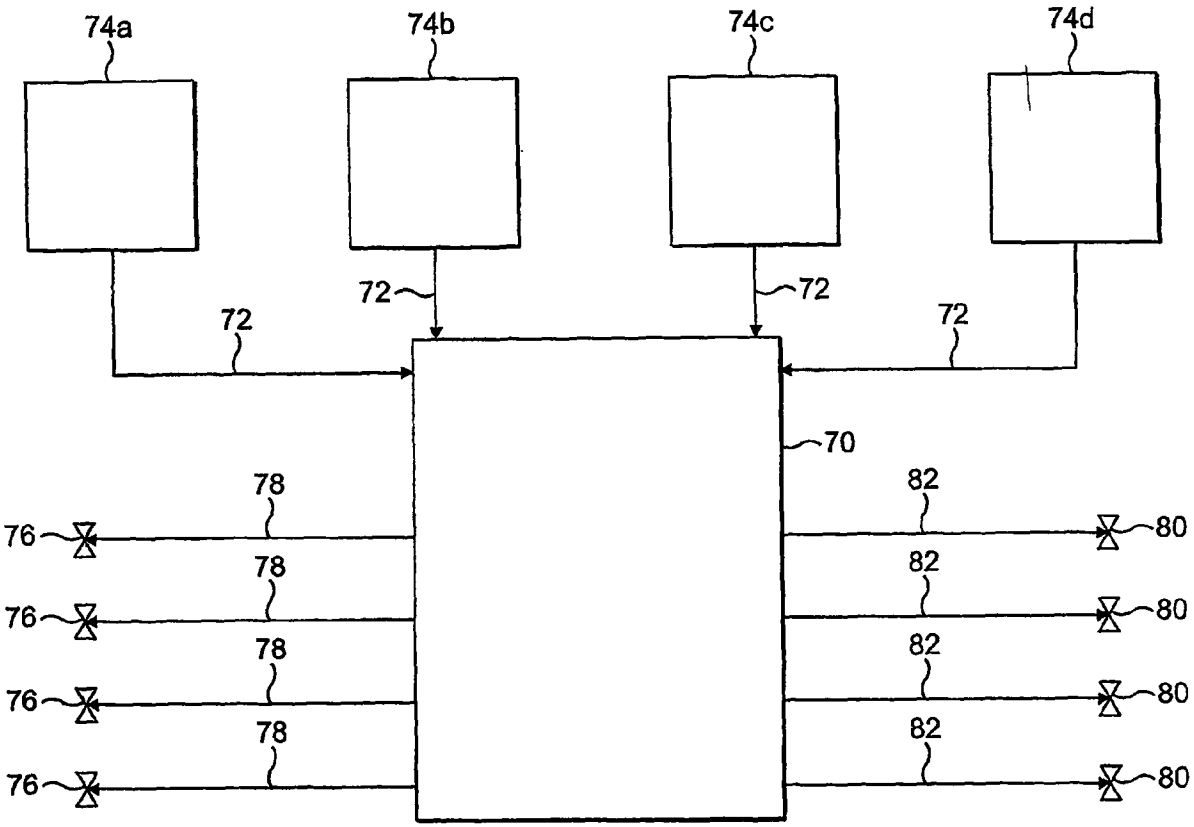
FIG. 7 illustrates a control system for controlling the relative amounts of fuel and oxidant supplied to each combustion nozzle.

FIG. 7 illustrates a control system for controlling the supply of the fuel and oxidant to each of the combustion nozzles 22. The control system comprises a controller 70 for receiving signals 72 data indicative of a variation of the chemistry of the exhaust gas supplied to each combustion nozzle 22, for example, at the start of a cleaning cycle when cleaning gases are supplied to the process chambers. As illustrated in FIG. 7, each of the signals 72 may be received directly from a respective process tool 74*a* to 74*d*, each process tool controlling the supply of gases to a respective process chamber 12*a* to 12*d*. Alternatively, the signals 72 may be received from a host computer of a local area network of which the controller 70 and the controllers of the process tools 74*a* to 74*d* form part, the host computer being configured to receive information from the controllers of the process tools regarding the chemistry of the gases supplied to the process chambers and to output the signals 72 to the controller 70 in response thereto. As another alternative, the signals 72 may be received from a plurality of gas sensors each located between the outlet of a respective process chamber and a respective combustion nozzle 22.

In response to the data contained in the received signals 72, the controller 70 may selectively control the relative amounts of fuel and oxidant supplied to each combustion nozzle 22. With reference to FIGS. 6 and 7, the control system includes a first plurality of variable flow control devices 76 each located between the oxidant source 32 and a respective oxidant inlet 30, and a second plurality of variable flow control devices 80 each located between the fuel source 42 and a respective fuel inlet 40. For example, the devices 76, 80 may be butterfly or other control valves having a conductance that can be varied in dependence on, preferably in proportion to, a signal 78, 82 received from the controller 70. Alternatively, fixed orifice flow control devices may be used to control the flow of fuel and/or oxidant into the nozzle 22. Therefore, to change the amount of oxidant supplied to a selected one of the nozzles 22, the controller 70 selectively outputs to the appropriate device 76 a signal 78 which causes the device 76 to vary the flow of oxidant to the selected nozzle, and to change the amount of fuel supplied to the selected nozzle 22, the controller 70 selectively outputs to the appropriate device 80 a signal 82 which causes the device 80 to vary the flow of fuel to the selected nozzle 22.

By varying the relative amounts of fuel and oxidant supplied to each nozzle 22, the controller 70 can selectively modify each combustion flame generated within the combustion chamber 24 in dependence on the chemistry of the exhaust gases. For example, the relative amounts of fuel and oxidant supplied to a nozzle 22 can be adjusted to produce an oxidising combustion flame when the exhaust gas contains ammonia, or to produce a reducing combustion flame when the exhaust gas contains $F_2$, $NF_3$ or $SF_6$ cleaning gas.

Increasing the relative amount of just one of the fuel and oxidant may vary the nature of the combustion flame. For example, the controller 70 may be configured to pre-set minimum amounts of fuel and oxidant to be supplied to each nozzle, with the relative amount of a chosen one of the fuel and oxidant being selectively increased at each nozzle 22 as required (by operating selected ones of the devices 76, 80 as required) to change the nature of the combustion flames.

Returning to FIG. 1, the by-products from the combustion of the exhaust gases within the combustion chamber 24 may be conveyed to a wet scrubber, solid reaction media, or other secondary abatement device 90, as illustrated in FIG. 1. After passing through the abatement device 90, the exhaust gas stream may be safely vented to the atmosphere.

In summary, apparatus is described for combusting exhaust gases output from a plurality of process chambers. The apparatus comprises a plurality of exhaust gas combustion nozzles connected to a combustion chamber. Each nozzle receives a respective exhaust gas, and comprises means for receiving a fuel and an oxidant for use in forming a combustion flame within the chamber. A controller receives data indicative of the chemistry of the exhaust gas supplied to each nozzle, and adjusts the relative amounts of fuel and oxidant supplied to each nozzle in response to the received data. This can enable the nature of each combustion flame to be selectively modified according to the nature of the exhaust gases to be destroyed by that flame, thereby enhancing the destruction rate efficiency of the exhaust gas and optimising fuel consumption.

The ability to modulate the flame conditions at each combustion nozzle also ensures that sufficient fuel is made available to act both as a heat source and as a chemical reagent in the abatement of fluorine and fluorine containing gases. This is essential in maximising the abatement efficiency that is achieved by the abatement equipment whilst reducing the fuel usage.

Whilst in the preferred embodiments described above a single combustion nozzle is used to convey the exhaust gas from a process chamber to the combustion chamber, the exhaust gas may be "split" into two or more streams, each of which is conveyed to a respective combustion nozzle. This has been found to increase further the efficiency at which the exhaust gases are destroyed.

The invention enables the nature of each combustion flame to be selectively modified depending on the nature of the received exhaust gas. This can enhance the destruction rate efficiency of the exhaust gas and optimise fuel consumption. For example, the amounts of fuel and oxidant supplied to a nozzle may be adjusted to produce an oxidising combustion flame when a first exhaust gas containing, for example, ammonia, is conveyed to the nozzle, and to produce a reducing combustion flame when a second exhaust gas different from the first exhaust gas, containing, for example, a cleaning gas such as one of $F_2$, $NF_3$ and $SF_6$, is conveyed to the nozzle.

High DRE rates can thus be achieved for both process and cleaning gases whilst allowing the fuel consumption at each nozzle to be individually optimised according to the nature of the exhaust gas conveyed to that nozzle. This can enable fuel consumption to be minimised, thereby reducing operating costs, and can enable a single combustion chamber to be provided for treating a plurality of different exhaust gases exhaust, for example, from a plurality of process chambers operating with different deposition and cleaning cycles.

The adjustment of the supply of the fuel and oxidant to a nozzle may be timed according to the deposition and cleaning cycles conducted within a process chamber. Alternatively, for each nozzle, data may be received which is indicative of a variation of the chemistry of the exhaust gas conveyed to that nozzle, the amounts of fuel and oxidant supplied to that nozzle being adjusted in response to the received data. In the preferred embodiment, each exhaust gas is exhausted from a process chamber of a process tool, with the data being supplied by the process tool. Alternatively, a gas sensor may be located within a conduit system for conveying the exhaust gas to the nozzle, with this sensor being configured to supply the data.

While the foregoing description and drawings represent the preferred embodiments of the present invention, it will be apparent to those skilled in the art that various changes and modifications may be made therein without departing from the true spirit and scope of the present invention.

We claim:

1. Apparatus for combusting exhaust gases comprising:

a combustion chamber;

a plurality of exhaust gas combustion nozzles each for conveying a respective exhaust gas into the combustion chamber, each nozzle having associated therewith a supply of fuel and a supply of oxidant;

control means for receiving, for each exhaust gas, data indicative of a variation of the chemistry of the exhaust gas, and for adjusting at least one of the supply of fuel and the supply of oxidant of each nozzle; and a plenum chamber receiving the supply of fuel and the supply of oxidant of each of the plurality of nozzles and receiving a supply of a fuel and oxidant gas mixture at an inlet separate from the nozzles, the supply of fuel and the supply of oxidant of each nozzle mixing with the supply of the fuel and oxidant gas mixture within the plenum chamber, the plenum chamber further comprising at least one outlet from the plenum chamber to the combustion chamber for each of the plurality of nozzles;

wherein the control means adjusts at least one of the supply of fuel and the supply of oxidant of a nozzle to produce an oxidizing combustion flame when the data is indicative of a first chemistry of the exhaust gas of the nozzle and to produce a reducing combustion flame when the data is indicative of a second chemistry of the exhaust gas of the nozzle.

2. The apparatus according to claim 1 wherein each nozzle comprises a first sleeve extending thereabout for receiving the oxidant, and a second sleeve substantially concentric with the first sleeve for receiving the fuel.

3. The apparatus according to claim 2 wherein the second sleeve extends about the first sleeve.

4. The apparatus according to claim 2 wherein each sleeve comprises a plurality of apertures surrounding the nozzle for outputting a respective one of the fuel and the oxidant.

5. The apparatus according to claim 1 wherein the combustion nozzles each extend within the plenum chamber substantially co-axial with the respective outlet therefrom.

6. The apparatus according to claim 1 wherein each said supply of fuel and supply of oxidant is configured to inject the fuel and the oxidant into the plenum chamber to vary the nature of a combustion flame formed within the combustion chamber.

7. The apparatus according to claim 1 wherein the control means comprises a plurality of first variable flow control devices each for varying the supply of oxidant to a respective nozzle, and a controller for selectively controlling each first variable flow control device in response to the received data.

8. The apparatus according to claim 7 wherein the control means comprises a plurality of second variable flow control devices each for varying the supply of fuel to a respective nozzle, the controller being configured to selectively control each second variable flow control device in response to the received data.

9. The apparatus according to claim 1 wherein the fuel comprises a hydrocarbon.

10. The apparatus according to claim 1 wherein the oxidant comprises oxygen.

11. The apparatus according to claim 1 comprising at least four nozzles each for receiving a respective exhaust gas.

12. Combustion apparatus comprising:

a combustion chamber;

a plurality of combustion nozzles each for conveying an exhaust gas into the combustion chamber, each combustion nozzle having an outer surface;

a plenum chamber for mixing fuel and oxidant, the plenum chamber comprising a plurality of outlets each extending about a respective nozzle such that each outlet is defined in part by an outer surface of a respective nozzle, each outlet providing a respective mixture of fuel and oxidant from the plenum chamber to the combustion chamber adjacent the exhaust gas provided to the combustion chamber by the combustion nozzle; and means for selectively varying the relative amounts of the fuel and the oxidant at each outlet according to the chemistry of the exhaust gas contained within the nozzle associated therewith such that the relative amounts of the fuel and the oxidant produce an oxidizing combustion flame when the exhaust gas has a first chemistry and to produce a reducing combustion flame when the exhaust gas has a second chemistry.

13. A method of combusting exhaust gases using a plurality of exhaust gas combustion nozzles connected to a combustion chamber, each nozzle having associated therewith a supply of fuel and a supply of oxidant, the method comprising:

conveying a respective exhaust gas to each nozzle;

for each nozzle, conveying the nozzle's associated supply of fuel and the nozzle's associated supply of oxidant to a plenum chamber that is common to the plurality of nozzles, mixing the nozzle's associated supply of fuel and the nozzle's associated supply of oxidant in the plenum chamber to produce a combustion gas that passes through a respective outlet of the plenum chamber to the combustion chamber;

forming from the combustion gas a combustion flame that burns the exhaust gas within the combustion chamber; and for each nozzle, adjusting at least one of the supply of fuel and the supply of oxidant with variation of the chemistry of the respective exhaust gas conveyed by the nozzle such that an oxidizing combustion flame is formed when the exhaust gas has a first chemistry and a reducing combustion flame is formed when the exhaust gas has a second chemistry.

14. The method according to claim 13 wherein the first exhaust gas comprises ammonia.

15. The method according to claim 13 wherein the second exhaust comprises a halogen-containing gas.

16. The method according to claim 13 wherein the second exhaust gas comprises at least one compound selected from the group consisting of F2, NF3 and SF6.

17. The method according to claim 13 comprising, for each nozzle, varying the supply of oxidant in response to the variation of the chemistry of the respective exhaust gas.

18. The method according to claim 13 comprising, for each nozzle, varying the supply of fuel in response to the variation of the chemistry of the respective exhaust gas.

19. The method according to claim 13 comprising, for each nozzle, adjusting at least one of the supply of fuel and the supply of oxidant in response to the reception of data indicative of a variation of the chemistry of the respective exhaust gas.

20. The method according to claim 19 wherein each respective exhaust gas is exhaust from a process tool, the data indicative of the variation of the chemistry of the exhaust gas being supplied by the process tool.

21. The method according to claim 13 wherein the fuel comprises a hydrocarbon.

22. The method according to claim 13 wherein the fuel comprises methane.

23. The method according to claim 13 wherein the oxidant comprises oxygen.

24. The method according to claim 13 comprising injecting the fuel and the oxidant into the plenum chamber from a plurality of apertures extending about the nozzle.

* * * * *